United States Patent [19]

Hayashi

[11] Patent Number: 4,568,634

[45] Date of Patent: Feb. 4, 1986

[54] PROCESSING COMPOSITION FOR USE IN SILVER SALT DIFFUSION TRANSFER CONTAINING ALKALI METAL PHOSPHATE SALT AND AMINOALCOHOL

[75] Inventor: Katsumi Hayashi, Kanagawa, Japan

[73] Assignee: Fuji Photo Film Co., Ltd., Kanagawa, Japan

[21] Appl. No.: 671,268

[22] Filed: Nov. 14, 1984

[30] Foreign Application Priority Data

Nov. 14, 1983 [JP] Japan ..... 58-213764

[51] Int. Cl.[4] ..... G03C 5/54; G03C 5/30; G03C 5/38

[52] U.S. Cl. ..... 430/449; 430/244; 430/249; 430/455; 430/487; 430/489; 430/490

[58] Field of Search ..... 430/227, 244, 249, 251, 430/449, 455, 487, 489, 490, 405

[56] References Cited

U.S. PATENT DOCUMENTS

| | | | |
|---|---|---|---|
| 3,576,633 | 4/1971 | Henn et al. | 430/489 |
| 3,645,731 | 2/1972 | Liebe et al. | 430/227 |
| 4,147,543 | 4/1979 | Kubotera et al. | 430/244 |
| 4,298,673 | 11/1981 | Kubotera et al. | 430/249 |
| 4,362,811 | 12/1982 | Iguchi et al. | 430/251 |

*Primary Examiner*—Richard L. Schilling

*Attorney, Agent, or Firm*—Sughrue, Mion, Zinn Macpeak & Seas

[57] ABSTRACT

The present invention relates to a composition for processing, by the silver salt diffusion transfer technique, a photographic material which contains a developing agent and at least one each of a silver halide photographic emulsion layer and an image receiving layer containing nuclei for physical development. The composition contains about 0.03 mol/l to about 0.10 mol/l of a phosphate salt and about 0.3 mol/l to about 1.0 mol/l of a compound of the following formula (I):

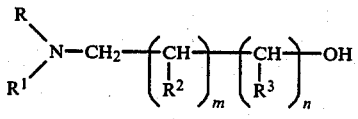

(I)

wherein R is a hydrogen atom or a lower alkyl group having 1 to 4 carbon atoms; $R^1$ is a hydrogen atom or a lower alkyl group having 1 to 4 carbon atoms; $R^2$ and $R^3$ are each a hydrogen atom or a hydroxyl group, respectively; m and n are each 0 or 1, provided that m and n are not 0 at the same time. The processing composition allows for obtaining a high contrast image by the silver salt diffusion transfer technique.

14 Claims, No Drawings

PROCESSING COMPOSITION FOR USE IN SILVER SALT DIFFUSION TRANSFER CONTAINING ALKALI METAL PHOSPHATE SALT AND AMINOALCOHOL

FIELD OF THE INVENTION

The present invention relates to a processing composition for use in the silver salt diffusion transfer technique. More particularly, the invention relates to a processing composition for obtaining a high contrast image by the silver salt diffusion transfer technique.

BACKGROUND OF THE INVENTION

The principles of the silver salt diffusion transfer process are described in U.S. Pat. No. 2,352,014 and other references. An imagewise exposed silver halide emulsion layer is either disposed in contact or brought into contact with an image receiving layer in the presence of a developing agent and a silver halide solvent, so that unexposed silver halide is converted to a soluble silver complex salt. In the exposed part of the silver halide emulsion layer, the silver halide is developed into silver, which is unable to dissolve any further and hence is incapable of diffusion. In the unexposed area of the silver halide emulsion layer, the silver halide is converted to a soluble silver complex salt, which is transferred to the image receiving layer where the complex salt forms a silver image usually in the presence of nuclei for physical development.

Silver salt diffusion transfer techniques find extensive use in reproduction of documents, making of lithographic printing plates, preparation of block copy materials and in instant photography (for a review of these applications, see A. Rott and E. Weyde, *Photographic Silver Halide Diffusion Transfer Processes,* Focal Press, London, 1972). For the purpose of accurately reproducing information carried by the original, it is important to produce a silver image of high maximum density, contrast and good definition in the image receiving layer for silver salt diffusion transfer. Being capable of providing high contrast, the silver salt diffusion process is highly adapted to the formation of a line image or a contact-screen halftone image.

Conventionally, most silver salt diffusion transfer techniques use a solution containing a developing agent and a silver halide solvent in order to process a light-sensitive material containing a silver halide emulsion layer and an image receiving material having an image receiving layer containing nuclei for physical development. This is gradually being replaced by a more recent and popular method wherein a light-sensitive material containing a developing agent and an image receiving material containing nuclei for physical development are processed by a solution which contains a silver halide solvent but which is substantially free of a developing agent.

In the new method, the processing composition contains no developing agent and its pH can be increased to a level that permits a significantly high transfer activity, and hence a faster transfer speed. However, if a processing composition having high pH is left in a diffusion transfer processor having a relatively large opening, the pH of the composition easily drops due mainly to the absorption of carbon dioxide in the air. The pH of the processing composition will also be decreased when it is used to process a photographic material on account of either the development reaction or the dissolution of an acid substance or the like from the light-sensitive material into the processing composition. In whichever case, the development activity of the processing composition is reduced in a manner that adversely affects the photographic performance of the processed material in respect to the maximum density, gradation and stain.

In order to ensure rapid development, the processing solution is usually rendered highly alkaline, i.e., at a pH in the range of about 10 to 14. For this purpose, an alkali metal salt of phosphoric acid such as trisodium phosphate (said salt is hereunder simply referred to as a phosphate salt) is preferably used.

However, as shown in Japanese Patent Application (OPI) No. 24349/81 (the term "OPI" as used herein refers to a "published unexamined Japanese patent application"), a phosphate salt used in a fairly large amount is not necessarily favorable to rapid development because, firstly, crystallization occurs easily, and, secondly, an excessively high ionic strength inhibits the swelling of a colloidal substance such as gelatin. Furthermore, the present inventors confirmed by experiments that when a processing composition containing a fairly large amount of the phosphate salt was used some time after its preparation, the transferred image had a reduced gradation or stain occurred within the image.

A substituted aminoalcohol represented by the formula: R—NH—$C_2H_4OH$ (R: lower alkyl group having 1 to 4 carbon atoms) is incorporated into a processing solution for the silver salt diffusion transfer process in an amount which usually ranges from about 5 to 20 ml per liter of the solution. This is effective in providing a faster transfer speed, higher contrast and better sharpness, but as is stated in Japanese Patent Application (OPI) No. 79445/80 (corresponding to U.S. Pat. No. 4,362,811), this compound accelerates the deposition of silver and causes an undesired decrease in the transfer density.

SUMMARY OF THE INVENTION

One object of the present invention is to provide a processing composition for use in the silver salt diffusion transfer technique that permits a faster transfer speed and which produces an image of high contrast and transfer density.

Another object of the present invention is to provide a processing composition for use in the silver salt diffusion, transfer technique that is capable of producing an image of high contrast and transfer density even if the composition is used some time after its preparation.

A further object of the present invention is to provide an alkali processing composition that is substantially free of a developing agent and which is capable of producing a line image or halftone image of good quality by the silver salt diffusion transfer technique.

These and other objects of the present invention can be accomplished by the following: a composition for processing by the silver salt diffusion technique a photographic material which contains a developing agent and at least one each of a silver halide photographic emulsion layer and an image receiving layer containing nuclei for physical development, said composition containing about 0.03 mol/l to about 0.12 mol/l of a phosphate salt and about 0.3 mol/l to about 1.0 mol/l of a compound of the formula (I):

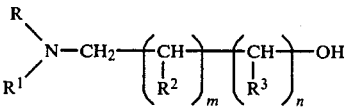

(I)

wherein R is a hydrogen atom or a lower alkyl group having 1 to 4 carbon atoms, preferably a hydrogen atom, a methyl group or an ethyl group; $R^1$ is a hydrogen atom or a lower alkyl group having 1 to 4 carbon atoms, preferably a hydrogen atom and an ethyl group; $R^2$ and $R^3$ are each a hydrogen atom or a hydroxyl group; m and n are each 0 or 1, provided that m and n are not 0 at the same time.

DETAILED DESCRIPTION OF THE INVENTION

The preferred application of the above-defined composition is for processing a photographic material consisting of a silver halide light-sensitive material containing a developing agent and an image receiving material containing nuclei for physical development. Preferably, the processing composition according to the present invention is substantially free of a developing agent. This composition usually contains a silver halide solvent.

The preferred amount of the phosphate salt referred to above ranges from about 0.06 mol/l to about 0.10 mol/l. The compound of formula (I) is preferably used in an amount of about 0.35 mol/l to about 0.75 mol/l.

Specific examples of the compound of formula (I) are listed below:

Compound 1: $H_2N—CH_2CH_2OH$

Compound 2: $CH_3—NHCH_2CH_2OH$

Compound 3: $NH_2CH_2CH_2CH_2OH$

Compound 4:

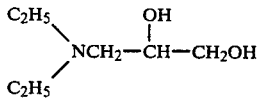

Of these compounds, Compound 2 is particularly preferred for use in the practice of the present invention. These compounds are disclosed in Japanese Patent Application (OPI) No. 79445/80 (corresponding to U.S. Pat. No. 4,362,811), Japanese Patent Publication No. 12835/66 (corresponding to U.S. Pat. No. 3,392,019), and other known references. Compound 2 may be synthesized by causing methylamine to act either on ethylene chlorohydrin, or on ethylene oxide. The other compounds can also be synthesized by similar methods.

The "phosphate salt" as used in this specification means an alkali metal (e.g., sodium or potassium) salt of phosphoric acid, and illustrative usable phosphate salts are trisodium phosphate, tripotassium phosphate, disodium phosphate and dipotassium phosphate. Trisodium phosphate and tripotassium phosphate are preferred, and trisodium phosphate is particularly preferred.

Alkali metal thiosulfates such as sodium thiosulfate and potassium thiosulfate are used as the silver halide solvent in the present invention. Sodium thiosulfate is preferred. These silver halide solvents are generally used in amounts ranging from about 0.06 mol/l to about 0.19 mol/l.

The processing composition used in the present invention may contain various photographic additives in addition to the compounds shown above, and illustrative additives are alkaline substances such as potassium hydroxide and sodium hydroxide; preservatives such as potassium sulfite and sodium sulfite; anti-foggants such as potassium bromide and sodium bromide; thickeners such as hydroxyethyl cellulose and carboxymethyl cellulose; toning agents; surfactants such as polyoxyalkylene compounds and onium compounds; water softeners such as Na salt of EDTA. The processing composition of the present invention should have a pH sufficient to maintain the desired development activity, and the necessary pH is in the range of 10 to 14, preferably from 10.5 to 12.8.

Illustrative toning agents include imidazolidine-2-thione, perhydrodiazine-2-thione, mercaptobenzimidazoles (e.g., 2-mercaptobenzimidazole, 2-mercapto-5-methylbenzimidazole, and 2-mercapto-5-chlorobenzimidazole, etc.), mercaptoimidazoles (e.g., 2-mercaptoimidazole, 2-mercapto-4-phenylimidazole, 1-methyl-2-mercapto-5-phenylimidazole, 1-benzyl-2-mercaptoimidazole and 2-mercapto-1-phenylimidazole, etc.), mercaptotriazoles (e.g., 3-mercapto-4,5-dimethyltriazole, and 4-p-toluyl-4H-1,2,4-triazole-3-thiol, etc.), mercaptobenzotriazoles (e.g., benzotriazole-2-thiol, etc.), tetrazol-5-thiols (e.g., 1-phenyl-5-mercaptotetrazole and 1-ethyl-5-mercapto-1H-tetrazole, etc.), mercaptopyrimidines (e.g., 2-mercaptopyrimidine, 2,4-dimercaptopyrimidine and 4-hydroxy-2,6-dimercaptopyrimidine, etc.), and tetraazapentalenes (e.g., 1,4-dimercapto-3H,6H-2,3a,5,6a-tetraazapentalene, and 3,6-diphenyl-1,4-dimercapto-3H,6H-2,3a,5,6a-tetraazapentalene, etc.).

These toning agents are used in varying amounts that depend on the type of the specific compound, and if the toning agents are incorporated into the processing composition, their amount generally ranges from about $1.5\times10^{-4}$ to $10^{-3}$ mol/l. Mercaptotetrazoles are preferably used as the toning agent.

The developing agent is preferably incorporated into the silver halide emulsion layer and/or an adjacent layer. If desired, the developing agent may be incorporated in the image receiving layer and/or an adjacent layer.

Preferred examples of the developing agents that may be used in the present invention are those as disclosed in T. H. James, *The Theory of the Photographic Process*, 4th Edition, Chapter 11, Macmillan (1977), and L. F. A. Mason, *Photographic Processing Chemistry*, 2nd Edition, pages 16–18 and 26–27, Focal Press (1975), for example, the illustrative developing agents include hydroquinones such as hydroquinone, t-butylhydroquinone and methylhydroquinone, etc.), and 3-pyrazolidinones such as 1-phenyl-3-pyrazolidinone, 4,4-dimethyl-1-phenyl-3-pyrazolidinone, 4-hydroxymethyl-4-methyl-1-phenyl-3-pyrazolidinone, 4,4-dimethyl-1-p-tolyl-3-pyrazolidinone, 4-hydroxymethyl-4-methyl-1-p-tolyl-3-pyrazolidinone, 1-p-tolyl-3-pyrazolidinone, 5,5-dimethyl-1-phenyl-3-pyrazolidinone, 4-methyl-1,5-diphenyl-3-pyrazolidinone, 5-methyl-1,5-diphenyl-3-pyrazolidinone, 4-methyl-1-phenyl-3-pyrazolidone, 5-methyl-1-phenyl-3-pyrazolidone, 4,4-dihydroxymethyl-1-phenyl-3-pyrazolidone, 4,4-dihydroxymethyl-1-p-tolyl-3-pyrazolidone, 1,4-diphenyl-3-pyrazolidone, 1,5-diphenyl-3-pyrazolidone, 4-methyl-4-hydroxymethyl-1-phenyl -3-pyrazolidone, 4-hydroxymethyl-1-phenyl-3-pyrazolidone, 1-o-tolyl-3-pyrazolidone, 1-m-tolyl-3-pyrazolidone, 1-p-tolyl-3-pyrazolidone, 4,5-dimethyl-1-phenyl-3-pyrazolidone, 1-p-hydroxyethylphenyl-3-pyrazolidone and 1,4-dimethyl-3-pyrazolidone, etc.

In the present invention, one compound selected from among these hydroquinones and 3-pyrazolidinones may be used. But more preferably, the two types of compounds are used in combination, and illustrative combinations are hydroquinone/4-hydroxymethyl-4-methyl-1-p-tolyl-3-pyrazolidinone, hydroquinone/4-hydroxymethyl-4-methyl-1-phenyl-3-pyrazolidinone, hydroquinone/4,4-dihydroxymethyl-1-phenyl-3-pyrazolidinone, and hydroquinone/4,4-dihydroxymethyl-1-p-tolyl-3-pyrazolidinone.

The hydroquinones are incorporated in the photographic material in an amount ranging from about 0.06 mole to about 6.3 mols, preferably from about 0.1 mol to about 1.5 mols, per mol of silver. The pyrazolidinones are incorporated in the photographic material in an amount ranging from about 0.006 mol to about 0.6 mol, preferably from about 0.02 to about 0.16 mol, per mol of silver.

The image receiving layer used in the present invention must always contain nuclei for physical development. Usually, this layer also contains a hydrophilic colloidal substance and a toning agent, as well as a brightener (e.g., fluorescent brightener), an antistain agent (e.g., boric acid), a surfactant (as a coating aid) or a hardener.

Any of the known nuclei for physical development may be used, and they include heavy metals such as zinc, mercury, lead, cadmium, iron, chromium, nickel, tin, cobalt and copper; noble metals such as palladium, platinum, silver and gold; as well as sulfides, selenides and tellurides of these metals. These nuclei for physical development may be prepared by reducing the corresponding metal ions and forming a metal colloidal dispersion, or by mixing a solution of the corresponding metal ions with a solution of a soluble sulfide, selenide or telluride to form a colloidal dispersion of a water-insoluble metal sulfide, selenide or telluride.

The functions of the nuclei for physical development used in silver salt diffusion transfer are described in, for example, U.S. Pat. No. 2,774,667 issued to Edwin H. Land, et al., on Dec. 18, 1956. In order to prepare an image receiving element that provides an image of high contrast, the nuclei for physical development are incorporated in an image receiving layer in an amount which generally ranges from $10^{-10}$ to $10^{-5}$ g/cm$^2$, preferably from $10^{-8}$ to $10^{-6}$ g/cm$^2$.

The image receiving layer containing the nuclei for physical development preferably contains a toning agent as required. The toning agent is a compound that is capable for modifying the color tone of a silver transfer image formed as a result of photographic processing. This toning agent may be selected from among those listed above for incorporation in the processing composition of the present invention. The amount of the toning agent to be incorporated in the image receiving layer depends on the type of the specific compound. If its amount is too small, the resulting silver transfer image assumes a dark red color, and if the amount of the toning agent is too large, a dull image occurs or the overall optical density is reduced. Therefore, the amount of the toning agent incorporated into the image receiving layer is generally in the range of from about $10^{-9}$ to $10^{-4}$ mol/m$^2$, preferably from $10^{-7}$ to $10^{-5}$ mol/m$^2$. Mercaptoimidazoles and mercaptotetrazoles are preferred toning agents for incorporation in the image receiving layer.

The image receiving material used in the present invention may also contain a silver halide solvent such as potassium thiosulfate or sodium thiosulfate.

Preferred embodiments of the present invention are hereunder described in greater detail.

A light-sensitive material to be processed by the composition of the present invention has at least one silver halide emulsion layer formed on a support. The deposit of silver halide generally ranges from 0.5 to 3.5 g/m$^2$ in terms of silver nitrate. The light-sensitive material may optionally contain an auxiliary layer such as a subbing layer, an intermediate layer, a protective layer or a release layer. In order to ensure uniform transfer, the silver halide emulsion layer in the light-sensitive material may be covered with a layer of a water-permeable binder of the type shown in Japanese Patent Publication Nos. 18134/63 (corresponding to U.S. Pat. No. 3,351,469) and 18135/63 (corresponding to U.S. Pat. No. 3,260,600), such as a sodium salt of methyl cellulose or carboxymethyl cellulose or sodium alginate, etc. This binder layer is made thin enough so that it does not subsantially block or inhibit the diffusion of unexposed silver halide grains. Both the silver halide emulsion layer in the light-sensitive material and the image receiving layer in the image receiving material should contain at least one hydrophilic colloidal material selected from among gelatin, a gelatin derivative such as phthalated gelatin, a cellulose derivative such as carboxymethyl cellulose or hydroxymethyl cellulose, and a hydrophilic polymeric colloidal substance such as dextrin, soluble starch, polyvinyl alcohol or polystyrene sulfonic acid.

The silver halide emulsion comprises a silver halide dispersed in one of the above listed hydrophilic colloidal substances, and illustrative silver halides are silver chloride, silver bromide, silver chlorobromide, and any one of these silver halides that also contain silver iodide. An emulsion made of silver chlorobromide is preferably used. The silver halide emulsion may be sensitized by various methods during its preparation or application to a support. For example, one method is chemical sensitization which, as is well known in the art, uses a sulfur compound such as sodium thiosulfate or alkylthiourea, or a gold compound such as gold rhodanide or gold chloride, or both of these two compounds. Usually, the emulsion is also sensitized to a wavelength of about 530 nm to 560 nm. If desired, it may be subjected to panchromatic sensitization.

The silver halide emulsion layer and/or image receiving layer may contain any of the compounds that are commonly used in the practice of the silver salt diffusion transfer process. Among these optional compounds are included anti-foggants such as tetraazaindene and mercaptotetrazoles, coating aids such as saponin and polyalkylene oxides, hardeners such as formalin and chrome alum, and plasticizers. The light-sensitive material, or image receiving material or a "monosheet" including both materials may be supported by any common supportive materials that are selected from paper, glass, films such as cellulose acetate film, polyvinyl acetal film, polystyrene film and polyethylene terephthalate film, metal supports covered by paper on both sides, and paper supports covered by an α-olefin polymer such as polyethylene on one or both sides.

Preferably, the support is overlaid with an antihalation layer made of a carbon black dispersion and/or dye, and the silver halide emulsion layer is formed on the antihalation layer. In a particularly preferred embodiment, a developing agent is incorporated in a composition from which the antihalation layer is applied to the support.

While trisodium phosphate is a preferred alkali substance, this compound is not suitable for rapid development since it crystallizes easily and inhibits the swelling of gelatin if it is used in a fairly large amount. Therefore, Japanese Patent Application (OPI) No. 24349/81 proposes solving this problem by using sodium (or potassium) silicate instead of trisodium phosphate. However, the present inventors confirmed by experiments that the silicate crystallized easily at low temperatures and its pH was prone to decrease on storage.

On the other hand, the substituted aminoalcohol of R—NH—$C_2H_4OH$ shown in Japanese Patent Application (OPI) No. 79445/80 (corresponding to U.S. Pat. No. 4,362,811) and other prior art references is known to cause a drop in the transfer density.

As shown above, the phosphate salt and substituted aminoalcohol have their own fatal defects when they are used in a processing composition, particularly one which is substantially free of a developing agent. However, in the specific embodiment of the processing composition of the present invention wherein the phosphate salt is used in an amount slightly smaller than is conventionally used and the substituted aminoalcohol is used in an amount slightly larger than is conventionally used, not only is the composition free from crystallization but it can also be left within a processor without sacrificing its ability to produce high transfer density and contrast. In short, the processing composition of the present invention ensures a higher transfer speed and provides line images or halftone images of good quality.

The present invention will now be described by reference to specific examples which are not intended to be limiting. Unless otherwise specified, all ratios, percentages, etc., are by weight.

EXAMPLE 1

Samples of image receiving material were prepared by forming an image receiving layer on one side of a paper support. The paper support had a basis weight of 110 g/m$^2$ and was coated with polyethylene on both sides. The image receiving layer was composed of a 4:1 mixture of gelatin (containing metallic palladium nuclei) and carboxymethyl cellulose. The image receiving layer was deposited in such an amount that the weight of the hydophilic colloid was 3 g/m$^2$ on a dry basis.

Samples of light-sensitive material were prepared by forming an antihalation gelatin layer and an orthochromatic sensitized gelatin silver chlorobromide emulsion layer on a paper support which was the same as used in the image receiving material. The antihalation gelatin layer (gelatin: 2 g/m$^2$) contained 0.25 g/m$^2$ of carbon black, 0.8 g/m$^2$ of hydroquinone and 0.2 g/m$^2$ of 4-hydroxymethyl-4-methyl-1-phenyl-3-pyrazolidinone. The emulsion layer overlying said antihalation layer contained 2.0 g/m$^2$, in terms of silver nitrate, of silver chlorobromide grains (silver bromide: 2 mol%) having an average size of 0.3 μm.

The emulsion side of each sample of the light-sensitive material was placed in contact with the image receiving layer of each sample of the image receiving material. The so prepared samples of photographic material were passed through a conventional developer containing the processing solutions having the formulations shown in the following table. Twenty seconds after leaving squeegee rollers, the image receiving material was peeled from the light-sensitive material. The processing temperature was 25° C.

TABLE

| | Sample No. | | | | | | |
|---|---|---|---|---|---|---|---|
| | A | B | C | D | E | F | G |
| Formulations of the Processing Compositions | | | | | | | |
| Water | 700 ml | 700 ml | 700 ml | 700 ml | 700 ml | 700 ml | 700 ml |
| Anhydrous $Na_2SO_3$ | 50 g | 50 g | 50 g | 50 g | 50 g | 50 g | 50 g |
| $Na_3PO_4.12H_2O$ | 75 g | 75 g | 30 g | 75 g | 40 g | 30 g | 40 g |
| Anhydrous $Na_2S_2O_3$ | 20 g | 20 g | 20 g | 20 g | 20 g | 20 g | 20 g |
| KBr | 0.8 g | 0.8 g | 0.8 g | 0.8 g | 0.8 g | 0.8 g | 0.8 g |
| Compound 2 | 11 ml | 55 g | 11 g | 100 g | 100 g | 55 g | 30 g |
| 1-Phenyl-5-mercapto-tetrazole | 70 mg | 70 mg | 70 mg | 70 mg | 70 mg | 70 mg | 70 mg |
| pH adjusted to 12.5 with NaOH | | | | | | | |
| Water to make | 1,000 ml | 1,000 ml | 1,000 ml | 1,000 ml | 1,000 ml | 1,000 ml | 1,000 ml |
| Test Results | | | | | | | |
| Yellow stain | None | None | None | Present | Present | None | None |
| Transfer density | 1.30 | 1.48 | 1.30 | 1.28 | 1.42 | 1.58 | 1.60 |
| Crystallization after standing at −5° C. | Yes | Yes | No | Yes | No | No | No |
| pH after leaving the composition in the processor for 5 days | 10.2 | 10.3 | 9.8 | 10.5 | 10.3 | 10.5 | 10.4 |
| Transfer density after leaving the composition in the processor for 5 days | 0.92 | 0.98 | 0.82 | 0.90 | 1.28 | 1.58 | 1.58 |

As is clear from the table, Samples A, B and D using a fairly large amount of the phosphate salt had the following defects: (1) crystallization occurred at low temperatures (−5° C.); (2) when the processing compositions were left in the processor for 5 days, they produced images having low transfer density (maximum density) and reduced contrast.

Samples D and E containing a fairly large amount of a compound of formula (I) had the following defects: (1) yellow staining occurred in the image receiving material; (2) a significant drop in the transfer density occurred when the processing compositions were left in the processor for 5 days.

Sample A using a fairly large amount of the phosphate but a fairly small amount of the compound of formula (I) also had the following defects: (1) crystallization occurred at low temperature (−5° C.); (2) when the processing composition was left in the processor for 5 days, it produced an image having low transfer density and reduced contrast.

Sample C using a fairly small amount of the phosphate and a fairly small amount of the compound of formula (I) was also defective in that the processing composition had a significant drop in pH and transfer density when it was left in the processor for 5 days.

Samples F and G according to the present invention which contained a fairly small amount of the phosphate salt and a fairly large amount of the compound of formula (I) had the following advantages: (1) crystallization did not occur even at low temperature (−5° C.); (2) no yellow staining occurred in the image receiving material; and (3) no drop in the transfer density occurred even after the processing compositions were left in the processor for 5 days.

While the invention has been described in detail and with reference to specific embodiments thereof, it will be apparent to one skilled in the art that various changes and modifications can be made therein without departing from the spirit and scope thereof.

What is claimed is:

1. A composition for processing a photographic material by the silver salt diffusion transfer technique which photographic material contains a developing agent and at least one each of a silver halide photographic emulsion layer and an image receiving layer containing nuclei for physical development, said composition containing about 0.03 mol/l to about 0.12 mol/l of an alkali metal phosphate salt and about 0.3 mol/l to about 1.0 mol/l of a compound of the following formula (I):

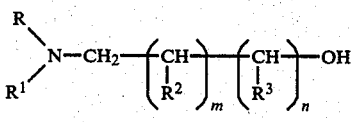

(I)

wherein R is a hydrogen atom or a lower alkyl group having 1 to 4 carbon atoms; $R^1$ is a hydrogen atom or a lower alkyl group having 1 to 4 carbon atoms; $R^2$ an $R^3$ are each a hydrogen atom or a hydroxyl group; m and n are each 0 or 1, provided that m and n are not 0 at the same time; said composition for processing a photographic material being an aqueous alkaline processing composition with a pH in the range of 10–14.

2. A composition claimed in claim 1, wherein the amount of the phosphate salt is in the range of from about 0.06 mol/l to about 0.1 mol/l.

3. A composition claimed in claim 1, wherein the compound of the formula (I) is present in an amount of about 0.35 mol/l to about 0.75 mol/l.

4. A composition claimed in claim 1, wherein the compound of the formula (I) is one member selected from the group consisting of:

Compound 1: $H_2N—CH_2CH_2OH$,

Compound 2: $CH_3—NHCH_2CH_2OH$,

Compound 3: $NH_2CH_2CH_2CH_2OH$, and

Compound 4:

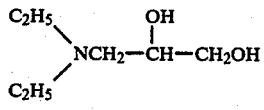

5. A composition claimed in claim 4, wherein the compound of the formula (I) is Compound 2.

6. A composition claimed in claim 1, wherein the image receiving layer of the photographic material contains a toning agent.

7. A composition claimed in claim 1, wherein the phosphate salt is selected from trisodium phosphate, tripotassium phosphate, disodium phosphate or dipotassium phosphate.

8. A composition claimed in claim 7, wherein the phosphate salt is trisodium phosphate or tripotassium phosphate.

9. A composition claimed in claim 8, wherein the phosphate salt is trisodium phosphate.

10. A composition claimed in claim 1, wherein the composition has a pH in the range of from 10.5 to 12.8.

11. A composition claimed in claim 1, wherein the developing agent of the photographic material is incorporated into the silver halide emulsion layer and/or an adjacent layer.

12. A composition claimed in claim 11, wherein the developing agent of the photographic material contains a combination of hydroquinones and 3-pyrazolidinones.

13. A composition claimed in claim 1, wherein the composition is substantially free of developing agent.

14. A composition claimed in claim 1, wherein the silver halide in the photographic emulsion layer of the photographic material is silver chlorobromide.

* * * * *